US008227161B2

(12) United States Patent
Shin et al.

(10) Patent No.: US 8,227,161 B2
(45) **Date of Patent: *Jul. 24, 2012**

(54) ELECTROPHOTOGRAPHIC TONER AND METHOD OF PREPARING THE SAME

(75) Inventors: Yoda Shin, Incheon (KR); Kyung-yol Yon, Seongnam-si (KR); Tac-hoe Koo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 746 days.

This patent is subject to a terminal disclaimer.

(21) Appl. No.: 12/119,582

(22) Filed: May 13, 2008

(65) Prior Publication Data

US 2009/0111038 A1 Apr. 30, 2009

(30) Foreign Application Priority Data

Oct. 31, 2007 (KR) ..... 10-2007-0110248

(51) Int. Cl.
*G03G 9/08* (2006.01)

(52) U.S. Cl. ..... 430/108.3; 430/108.7; 430/110.1; 399/222

(58) Field of Classification Search ..... 430/108.3, 430/108.7, 110.1; 399/159, 222
See application file for complete search history.

(56) References Cited

U.S. PATENT DOCUMENTS

| | | | | |
|---|---|---|---|---|
| 2008/0166649 | A1* | 7/2008 | Moffat et al. | 430/108.8 |
| 2010/0067956 | A1* | 3/2010 | Cheong et al. | 399/254 |
| 2010/0143835 | A1* | 6/2010 | Shin et al. | 430/110.3 |
| 2010/0159379 | A1* | 6/2010 | Lee et al. | 430/108.7 |

OTHER PUBLICATIONS

Diamond, Handbook of Imaging Materials, Marcel Dekker, NY, NY. 1991, pp. 160-163.*

* cited by examiner

*Primary Examiner* — Peter Vajda
(74) *Attorney, Agent, or Firm* — Stanzione & Kim, LLP

(57) ABSTRACT

An electrophotographic toner includes a latex, a coloring agent, a wax and 3 to 1,000 ppm of each of Si and Fe, wherein a mole ratio of Si to Fe is from 0.1 to 5.

20 Claims, 5 Drawing Sheets

ELECTROPHOTOGRAPHIC TONER AND METHOD OF PREPARING THE SAME

CROSS-REFERENCE TO RELATED APPLICATIONS

This application claims priority under 35 U.S.C. §119(a) from Korean Patent Application No. 10-2007-0110248, filed on October 31, in the Korean Intellectual Property Office, the disclosure of which is incorporated herein in its entirety by reference.

BACKGROUND OF THE INVENTION

1. Field of the Invention

The present general inventive concept relates to an electrophotographic toner and a method of preparing the same, and more particularly, to an electrophotographic toner which presents a reduced risk to human health and the environment and has excellent durability, and can be fixed at a low temperature and prepared in a fine particle size, and a method of preparing the electrophotographic toner whereby the toner is efficiently agglomerated.

2. Description of the Related Art

In electrophotographic processes and electrostatic recording processes, a developer used to visualize electrostatic images or electrostatic latent images can be classified into a two-component developer formed of toner and carrier particles and a one-component developer formed of only toner. The one-component developer can be classified into a magnetic one-component developer and a nonmagnetic one-component developer. Fluiding agents such as colloidal silica are often independently added to the nonmagnetic one-component developer in order to improve fluidity of toner. Generally, coloring particles prepared by dispersing a pigment such as carbon black or other additives in a latex are used as toner.

Toner can be prepared by pulverization or polymerization. According to the pulverization method, toner is prepared by melting and mixing synthetic resins with pigments and, if required, other additives, pulverizing the mixture, and sorting particles until particles of a desired size are obtained. According to the polymerization method, a polymerizable monomer composition is manufactured by uniformly dissolving or dispersing various additives such as a pigment, a polymerization initiator and, if required, a cross-linking agent and an antistatic agent in a polymerizable monomer. Then, the polymerizable monomer composition is dispersed in an aqueous dispersive medium which includes a dispersion stabilizer using an agitator to shape minute liquid droplet particles. Subsequently, a temperature is increased and suspension polymerization is performed to obtain polymerized toner having coloring polymer particles of a desired size.

In image forming apparatuses such as electrophotographic apparatuses or electrostatic recording apparatuses, an image is formed by exposing an image on a uniformly charged photoreceptor to form an electrostatic latent image; attaching toner to the electrostatic latent image to form a toner image; transferring the toner image onto a transfer member such as transfer paper or the like; and then fixing the toner image on the transfer member using any of a variety of methods including heating, pressurizing, solvent seaming, and the like. In most fixing processes, the transfer medium with the toner image passes through fixing rollers and pressing rollers, and by heating and pressing, the toner image is fused to the transfer medium.

Images formed by an image forming apparatus such as an electrophotocopier should satisfy requirements of high precision and accuracy. Conventionally, toner used in an image forming apparatus is usually obtained using pulverization. In pulverization, coloring particles having a large range of sizes are formed. Thus, to obtain satisfactory developing properties, there is a need to sort the coloring particles obtained through pulverization according to a size to reduce the particle size distribution. However, precisely controlling the particle size and the particle size distribution using a conventional mixing/pulverizing process in the manufacture of toner suitable for an electrophotographic process or an electrostatic recording process is difficult. Also, when preparing a fine-particle toner, the toner preparation yield is adversely affected by the sorting process. In addition, there are limits to change/adjustment of a toner design for obtaining desirable charging and fixing properties. Accordingly, polymerized toner, the size of particles of which is easy to control and which do not need to undergo a complex manufacturing process such as sorting, has been highlighted recently.

When toner is prepared through polymerization, polymerized toner having a desired particle size and particle size distribution can be obtained without pulverizing or sorting. However, although such polymerization is used, agglomeration of a latex and a coloring agent is not efficiently performed, and an aluminum-based material used as an agglomerating agent is hazardous to human health and the environment.

SUMMARY OF THE INVENTION

The present general inventive concept provides an electrophotographic toner which has improved durability and presents a reduced risk to human health and the environment, and can be fixed at a low temperature.

The present general inventive concept also provides a method of preparing the electrophotographic toner.

The present general inventive concept also provides a method of forming images by employing the electrophotographic toner.

The present general inventive concept also provides an image forming apparatus employing the electrophotographic toner.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an electrophotographic toner including a latex, a coloring agent, a wax, and 3 to 1,000 ppm of Si and Fe, wherein a mole ratio of Si to Fe is from 0.1 to 5.

An average particle size of the toner may be in a range of 3 to 8 μm.

An average sphericity of the toner may be in a range of 0.940 to 0.970.

The average sphericity difference between toner having the average particle size of 2 μm and 5 μm may be less than 0.02.

GSDv and GSDp values of the toner may be respectively less than 1.25.

The foregoing and/or other aspects and utilities of the general inventive concept may also be achieved by providing a method of preparing an electrophotographic toner, the method including preparing a first agglomerated toner by mixing first latex particles including a wax with a pigment dispersion, and adding a metal salt including Si and Fe to the mixture, and preparing a second agglomerated toner by coating a second latex obtained by polymerizing one or more polymerizable monomers on the first agglomerated toner.

The method may further include coating a third latex prepared by polymerizing at least one polymerizable monomers on the second agglomerated toner.

The first latex particles may include polyester, a polymer obtained by polymerizing at least one or more polymerizable monomers, or a mixture of the polyester and the polymer.

The foregoing and/or other aspects and utilities of the general inventive concept may also be achieved by providing a method of forming images including attaching the toner to a surface of a photoreceptor on which an electrostatic latent image is formed to form a visualized image and transferring the visualized image to a transfer medium, wherein the toner is an electrophotographic toner including a latex, a coloring agent, a wax, and 3 to 1,000 ppm of Si and Fe, wherein a mole ratio of Si to Fe is from 0.1 to 5.

The foregoing and/or other aspects and utilities of the general inventive concept may also be achieved by providing an image forming apparatus including an organic photoreceptor, an image forming unit to form an electrostatic latent image on a surface of the organic photoreceptor, a unit to receive toner, a toner supplying unit to supply the toner onto the surface of the organic photoreceptor in order to form a toner image by developing the electrostatic latent image to form the toner image, and a toner transferring unit to transfer the toner image to a transfer medium from the surface of the organic photoreceptor, wherein the toner is an electrophotographic toner including a latex, a coloring agent and a wax, wherein the toner further includes 3 to 1,000 ppm of Si and Fe and a mole ratio of Si to Fe is from 0.1 to 5.

The foregoing and/or other aspects and utilities of the general inventive concept may also be achieved by providing a developing unit usable with an image forming apparatus, the developing unit including a storage portion to store an electrophotographic toner, wherein the electrophotographic toner includes a latex, a coloring agent, a wax and 3 to 1,000 ppm of each of Si and Fe such that a mole ratio of Si to Fe is from 0.1 to 5.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
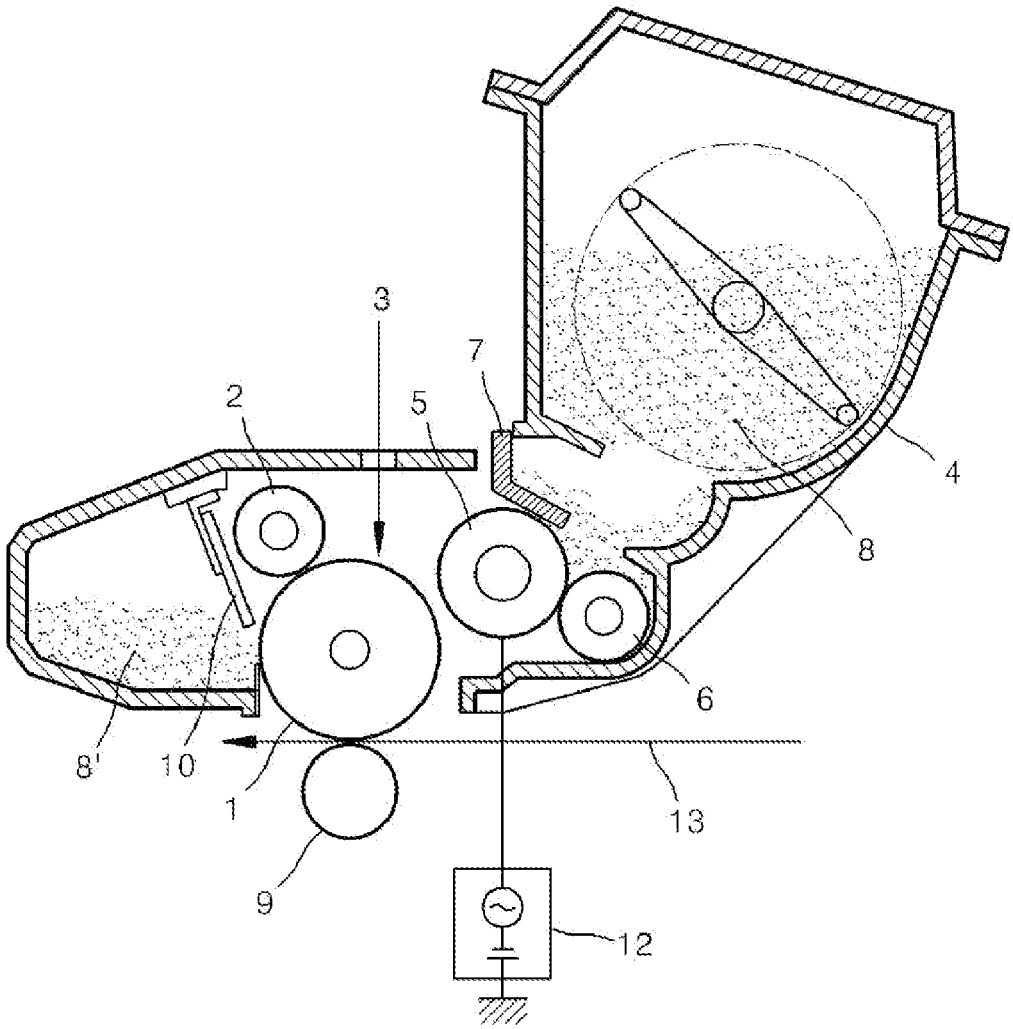
FIG. 1 is an image forming apparatus employing toner prepared according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The present general inventive concept provides an electrophotographic toner which presents a reduced risk to human health and the environment and has excellent durability, and can be more efficiently fixed at a low temperature and prepared in a fine particle size by using a metal salt including Si and Fe as a metal agglomerating agent. The present general inventive concept also provides a method of preparing the electrophotographic toner. By using the metal salt including Si and Fe, the toner can be efficiently agglomerated using only a small amount of the metal salt at a lower temperature, residues can be minimized, and a coloring pigment, particularly a rhodamine-based pigment, can be efficiently agglomerated.

The electrophotographic toner includes a latex, a coloring agent and a wax, and includes 3 to 1,000 ppm of each of Si and Fe, respectively, wherein a mole ratio of Si to Fe is from 0.1 to 5.

Since a metal salt including Si and Fe is used as an agglomerating agent in the manufacturing process of toner, the electrophotographic toner includes 3 to 1,000 ppm, of each of Si and Fe. When a concentration of Si and Fe respectively is less than 3 ppm, desired effects cannot be obtained. Alternatively, when the concentration of Si and Fe respectively is greater than 1,000 ppm, problems such as charge reduction may occur.

The mole ratio of Si to Fe may be in a range of 0.1 to 5, such as 0.15 to 3. When the mole ratio of Si to Fe is less than 0.1, a reduction in cohesion of toner may be caused. Alternatively, when the mole ratio of Si to Fe is greater than 5, charge reduction may occur.

Fine-particle toner can be prepared by using a metal salt including Si and Fe as an agglomerating agent in the manufacture of toner, and particle size of the toner can be regulated. Accordingly, an average particle size of the toner is in a range of 3 to 8 μm, and an average sphericity of the toner is in a range of 0.940 to 0.970. In particular, the average sphericity difference between toner having the average particle size of 2 μm and 5 μm is less than 0.02, and thus uniformity of particles can be improved. In particular, GSD(p,v) values may be 1.25 or less, such as from 1.23 to 1.2.

The present general inventive concept provides a method of preparing an electrophotographic toner whereby agglomeration of toner can be efficiently achieved by using a metal salt including Si and Fe as an agglomerating agent.

The method includes preparing a first agglomerated toner by mixing first latex particles including a wax with a pigment dispersion, and adding a metal salt including Si and Fe to the mixture; and preparing a second agglomerated toner by coating a second latex obtained by polymerizing one or more polymerizable monomers on the first agglomerated toner.

A size of the first agglomerated toner is increased by increased ionic strength by the addition of the metal salt including Si and Fe and collisions between the particles during the method of manufacturing the toner. An example of the metal salt is polysilica iron. In particular, products of SOODO Mechanical Co. (Model Nos. PSI-025, PSI-050, PSI-075, PSI-100, PSI-200 and PSI-300) sold and available in the market can be used. Properties and compositions of PSI-025, PSI-050 and PSI-075 are listed in Table 1 below.

TABLE 1

| | | PSI-025 | PSI-050 | PSI-075 |
|---|---|---|---|---|
| Silica/Fe ratio (Si/Fe) | | 0.25 | 0.5 | 0.75 |
| Concentration of main component | Fe (wt %) | 5.0 | 3.5 | 2.5 |
| | SiO2 (wt %) | 1.4 | 1.9 | 2.0 |
| pH (1 w/v %) | | | 2-3 | |
| Specific gravity (20° C.) | | 1.14 | 1.13 | 1.09 |
| Viscosity (mPa · S) | | | 2.0 or higher | |
| Mean molecular weight (Dalton) | | | 500,000 | |
| Appearance | | | Yellowish brown transparent liquid | |

The first latex particles may be polyester; a polymer obtained by polymerizing one or more polymerizable monomers; or a mixture thereof (a hybrid type). When the polymer is used as the first latex particles, the polymerizable monomers can be polymerized with a wax, or a wax can be added to the polymer. A wax-containing latex having a particle size of 1 μm or less, such as in a range of 100 to 300 nm can be prepared by emulsion polymerization.

Here, the polymerizable monomer may be at least one monomer selected from the group consisting of styrene-based monomers such as styrene, vinyl toluene and a-methyl styrene; acrylic acid or methacrylic acid; derivatives of (metha) acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and metacryl amide; ethylenically unsaturated monoolefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

The wax used in the process of preparing the first latex particles functions to provide toner which can be fixed on a final image receptor at a low temperature, and has excellent durability of a final image and wear resistance. Examples of the wax are polyethylene-based wax, polypropylene-based wax, silicone wax, paraffin-based wax, ester-based wax, carbauna wax and metallocene wax, but are not limited thereto. In particular, the wax used in the toner may have a melting point in a range of about 50 to 150° C. Components of the wax physically adhere to toner particles, but may not covalently bind with the toner particles.

An amount of the wax may be 1 to 20 parts by weight based on 100 parts by weight of the polymerizable monomer. When the amount of the wax is less than 1 parts by weight based on 100 parts by weight of the polymerizable monomer, toner particles cannot be fixed at a low temperature. Alternatively, when the amount of the wax is greater than 20 parts by weight based on 100 parts by weight of the polymerizable monomer, manufacturing costs are increased.

A polymerization initiator and a chain transfer agent may be used in the process of preparing the first latex for the efficiency of the polymerization.

Examples of the polymerization initiator are persulfate salts such as potassium persulfate and ammonium persulfate; azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1,1-bis(hydroxymethyl )-2-hydroxyethylpropioamide, 2,2'-azobis(2,4-dimethyl valeronitrile), 2,2'-azobis isobutyronitrile and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate and di-t-butylperoxy isophthalate. Also, an oxidization-reduction initiator in which the polymerization initiator and a reduction agent are combined may be used.

A chain transfer agent is a material to convert a type of chain carrier in a chain reaction. A new chain has much less activity than that of a previous chain. The polymerization degree of the monomer can be reduced and new chains can be initiated using the chain transfer agent. In addition, a molecular weight distribution can be adjusted using the chain transfer agent.

Examples of the chain transfer agent are sulfur containing compounds such as dodecanthiol, thioglycolic acid, thioacetic acid and mercaptoethanol; phosphorous acid compounds such as phosphorous acid and sodium phosphite; hypophosphorous acid compounds such as hypophosporous acid and sodium hypophosphite; and alcohols such as methyl alcohol, ethyl alcohol, isopropyl alcohol and n-butyl alcohol, but are not limited thereto.

The first latex particles may further include a charge control agent. The charge control agent used herein may be a negative charge type charge control agent or a positive charge type charge control agent. The negative charge type charge control agent may be an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any known charge control agent may be used without limitation. The positive charge type charge control agent may be a modified product such as nigrosine and a fatty acid metal salt thereof and an onium salt including a quaternary ammonium salt such as tributylammonium 1-hydroxy-4-naphthosulfonate and tetrabutylammonium tetrafluoro borate which may be used alone or in combination of at least two. Since the charge control agent stably supports toner on a developing roller by electrostatic force, charging may be performed stably and quickly using the charge control agent.

The prepared first latex may be mixed with a pigment dispersion. The pigment dispersion can be prepared by homogeneously dispersing a composition including pigments such as black, cyan, magenta and yellow and an emulsifier using a ultrasonic processor, Micro fluidizer, or the like.

Carbon black or aniline black may be used as the pigment for a black toner, and for color toner, at least one of yellow, magenta and cyan pigments are further included.

A condensation nitrogen compound, an isoindolinone compound, an anthraquine compound, an azo metal complex or an allyl imide compound can be used as the yellow pigment. In particular, C.I. pigment yellow 12, 13, 14, 17, 62, 74, 83, 93, 94, 95, 109, 110, 111, 128, 129, 147, 168, 180, or the like can be used.

A condensation nitrogen compound, an anthraquine compound, a quinacridone compound, a base dye lake compound, a naphthol compound, a benzo imidazole compound, a thioindigo compound or a perylene compound can be used as the magenta pigment. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like can be used.

A copper phthalocyanine compound and derivatives thereof, an anthraquine compound, or a base dye lake compound can be used as the cyan pigment. In particular, C.I. pigment blue 1, 7, 15, 15:1, 15:2, 15:3, 15:4, 60, 62, 66, or the like can be used.

Such pigments can be used alone or in a combination of at least two pigments, and are selected in consideration of color, chromacity, luminance, resistance to weather, dispersion capability in toner, etc.

The amount of the pigment as described above may be 0.1 to 20 parts by weight based on 100 parts by weight of the polymerizable monomer. The amount of the pigment should be sufficient to color the toner; however, when the amount of the pigment is less than 0.1 parts by weight based on 100 parts by weight of the polymerizable monomer, the coloring effect is not sufficient. Alternatively, when the amount of the pigment is greater than 20 parts by weight based on 100 parts by weight of the polymerizable monomer, the manufacturing costs of the toner increase, and thus a sufficient frictional charge amount cannot be obtained.

Any emulsifier that is known in the art may be used as the emulsifier used in the pigment dispersion. In this regard, an anionic reactive emulsifier, a nonionic reactive emulsifier or a mixture thereof can be used. The anionic reactive emulsifier may be HS-10 (Dai-ich kogyo, Co., Ltd.), Dawfax 2-A1 (Rhodia Inc.), etc., and the nonionic reactive emulsifier may be RN-10 (Dai-ichi kogyo, Co., Ltd.).

The prepared first latex particles and the pigment dispersion are mixed, and then a metal salt including Si and Fe is added to the mixture to prepare agglomerated toner. More particularly, when the first latex particles and the pigment dispersion are mixed, the metal salt including Si and Fe is added to the mixture at pH 1 to 4 to form a first agglomerated toner having an average particle size of 2.5 μm as a core. Then, a second latex is added to the resultant, and the pH is adjusted to 6 to 8. When the particle size is constantly maintained for a certain period of time, the resultant is heated to a temperature in a range of 90 to 96° C., and the pH is adjusted to 5.8 to 6 to prepare a second agglomerated toner.

The second latex can be prepared by polymerizing one or more polymerizable monomers. The polymerizable monomers are emulsion polymerized to prepare latex having a particle size of less than 1 μm, and in a range of 100 to 300 nm. The second latex may also include a wax, and the wax may be added to the second latex in the polymerization process.

Meanwhile, a third latex prepared by polymerizing one or more polymerizable monomers may be coated on the second agglomerated toner.

By forming a shell layer with the second latex or the third latex, durability can be improved, and storage problems of toner during shipping and handling can be overcome. Here, a polymerization inhibitor can be added in order to prevent new latex particles from being formed, or the reaction can be performed using a starved-feeding process to facilitate coating of the monomer mixture on the toner.

The prepared second agglomerated toner or third agglomerated toner is filtered to separate toner particles and the toner particles are dried. The dried toner particles are subject to a surface treatment process using silica or the like, and charge amount is controlled to prepare a final dry toner.

The molecular weight, Tg and Theological properties of the first latex particles formed in the core of toner prepared according to the method described above may be adjusted to efficiently fix toner particles at a low temperature.

The volume average diameter of the prepared toner particles may be in a range of 3 to 8 μm, such as 5 to 8 μm. When the volume average diameter of the toner particles is less than 3 μm, problems of cleaning a photoreceptor and a reduction in yield may occur. Alternatively, when the volume average diameter of the toner particles is greater than 8 μm, charging cannot be uniformly performed, fixing properties of the toner may be decreased, and a Dr-Blade cannot regulate the toner layer.

The present general inventive concept also provides a method of forming images including attaching the toner to a surface of a photoreceptor on which an electrostatic latent image is formed to form a visualized image and transferring the visualized image to a transfer medium, wherein the toner is an electrophotographic toner including 3 to 1,000 ppm of each of Si and Fe, wherein a mole ratio of Si to Fe is from 0.1 to 5.

A representative electrophotographic image forming process includes a series of processes of forming images on a receptor including charging, exposure to light, developing, transferring, fixing, cleaning and erasing.

In the charging process, a surface of a photoreceptor is charged with negative or positive charges, whichever is desired, by a corona or a charge roller. In the light exposing process, an optical system, conventionally a laser scanner or an array of diodes, selectively discharges the charged surface of the photoreceptor in an imagewise manner corresponding to a final visual image formed on a final image receptor to form a latent image. The optical system uses electromagnetic radiation, also referred to as "light", which can be infrared light irradiation, visible light irradiation, or ultra-violet light irradiation.

In the developing process, suitably charged toner particles generally contact the latent image of the photoreceptor, and conventionally, an electrically-biased developer having identical potential polarity to the toner polarity is used. The toner particles move to the photoreceptor and are selectively attached to the latent image by electrostatic force to form a toner image on the photoreceptor.

In the transferring process, the toner image is transferred to the final image receptor from the photoreceptor, and sometimes, an intermediate transferring element is used when transferring the toner image from the photoreceptor to aid the transfer of the toner image to the final image receptor.

In the fixing process, the toner image of the final image receptor is heated and the toner particles thereof are softened or melted, thereby fixing the toner image to the final image receptor. Another way of fixing is to fix toner on the final image receptor under high pressure with or without the application of heat.

In the cleaning process, residual toner remaining on the photoreceptor is removed.

Finally, in the erasing process, charges of the photoreceptor are exposed to light of a predetermined wavelength band and are reduced to be substantially uniform and of low value, and thus the residue of the organic latent image is removed and the photoreceptor is prepared for a next image forming cycle.

The present general inventive concept also provides an image forming apparatus including an organic photoreceptor; an image forming unit to form an electrostatic latent image on a surface of the organic photoreceptor; a unit to receive toner; a toner supplying unit to supply the toner onto the surface of the organic photoreceptor in order to form a toner image by developing the electrostatic latent image; and a toner transferring unit to transfer the toner image to a transfer medium from the surface of the organic photoreceptor, wherein the toner is an electrophotographic toner including a latex, a coloring agent and a wax. The toner includes 3 to 1,000 ppm of each of Si and Fe, wherein a mole ratio of Si to Fe is from 0.1 to 5.

FIG. 1 is an image forming apparatus employing toner prepared according to an embodiment of the present general inventive concept.

Referring to FIG. 1, a developer 8, which is a nonmagnetic one-component developer of a developing unit 4, is supplied to a developing roller 5 through a feeding roller 6 formed of an elastic material such as a polyurethane foam or sponge. The developer 8 supplied to the developing roller 5 reaches a contact point between the developing roller 5 and a developer regulation blade 7 as the developing roller 5 rotates. The developer regulation blade 7 is formed of an elastic material such as a flexible metal or rubber. When the developer 8 passes the contact point between the developing roller 5 and the developer regulation blade 7, the developer 8 is smoothed to form a thin layer that is sufficiently charged. The developing roller 5 transfers the thin layer of the developer 8 to a developing domain of a photoreceptor 1 where the thin layer of the developer 8 is developed on an electrostatic latent image of the photoreceptor 1, which is a latent image carrier. The electrostatic latent image is formed by scanning light 3 onto the photoreceptor 1.

The developing roller 5 and the photoreceptor 1 face each other with a predetermined distant therebetween. The developing roller 5 rotates counterclockwise and the photoreceptor 1 rotates clockwise.

The developer 8 transferred to the developing domain of the photoreceptor 1 forms a toner image by developing an electrostatic latent image on the photoreceptor 1 according to an intensity of an electric charge generated due to a difference between an AC voltage superposed with a DC voltage applied to the developing roller 5 and a latent image potential of the photoreceptor 1 that is charged by a charging unit 2.

The developer 8 developed on the photoreceptor 1 is transferred to a transferring unit 9 as the photoreceptor 1 rotates. The developer 8 developed on the photoreceptor 1 is transferred to a recording medium such as a sheet of paper 13 by corona discharge or a roller to which a high voltage opposite in polarity to that of the developer 8 is applied as the paper 13 passes through the developer 8 developed on the photoreceptor 1, and thus an image is formed.

The image transferred to the printing paper 13 is fused to the printing paper 13 when the image passes through a high-temperature and high-pressure fixing device (not illustrated). Meanwhile, developer 8' remaining on the developing roller 5 and which is not developed is transferred back to the feeding roller 6 contacting the developing roller 5. Remaining developer 8' that is undeveloped on the photoreceptor 1 is collected by a cleaning blade 10. The above processes are repeated.

The present general inventive concept will be described in more detail with reference to the examples below, but is not limited thereto. The following examples are for illustrative purposes only and are not intended to limit the scope of the present general inventive concept.

EXAMPLE 1

Synthesis of First Latex

A dispersion of a wax and a polymer was prepared using the following procedure.

A monomer mixture of 234 g of styrene, 96 g of n-butyl acrylate, 14 g of methacrylic acid and 6.5 g of polyethylene glycol-ethyl ether methacrylate, and 5 g of dodecanthiol as a chain transfer agent were mixed. The monomer mixture, 45 g of a wax and 0-4% of HS-10 solution were mixed and emulsified at a temperature from 60 to 70° C. using an ultrasonic homogenizer.

Figure 2:
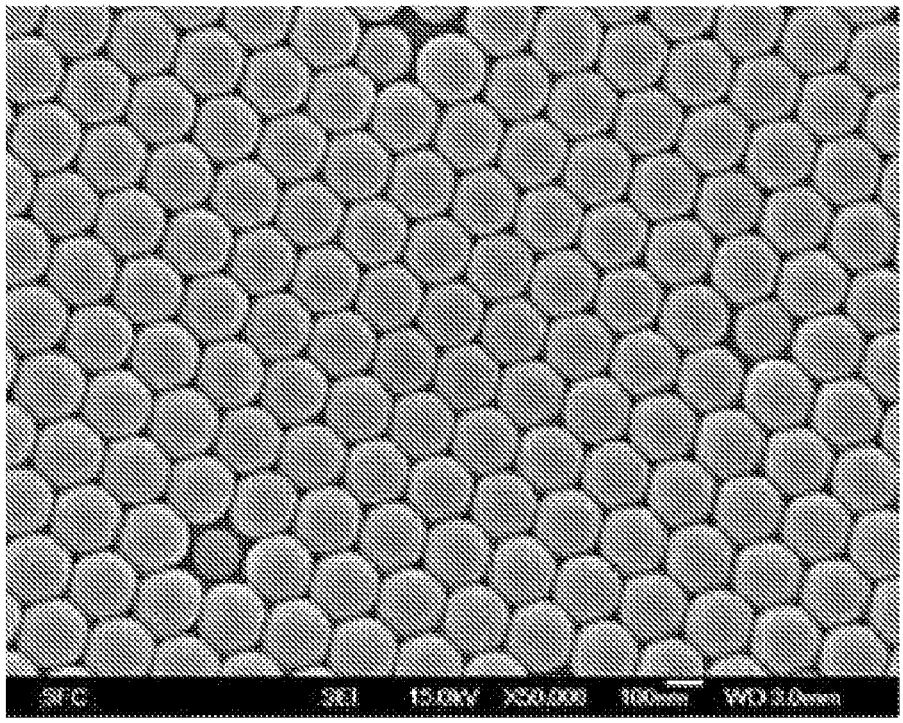
FIG. 2 is a scanning electron microscope (SEM) image of first latex particles prepared according to Example 1.

The prepared wax/polymer dispersion was added to a reactor that was heated to 80° C., 760 g of 3.2% KPS aqueous solution as a polymerization initiator was added thereto, and then the resultant was reacted for 2 hours in a nitrogen gas stream. When the reaction was terminated, a monomer mixture of 145 g of styrene, 66 g of n-butyl acrylate and 9 g of methacrylic acid, and 3.3 g of 1-dodecanethiol was added to the reactor using a starved feed process for 60 minutes and the mixture was further reacted for 6 hours. Then, the resultant was cooled naturally to obtain first latex particles. The particle size of the resultant toner latex was measured by a light scattering apparatus (Horiba 910) to be 200 nm. FIG. 2 is a scanning electron microscope (SEM) image of the first latex particles prepared according to Example 1.

Preparation of Pigment Dispersion 10 g of a mixture of an anionic reactive emulsifier (HS-10; DAI-ICH KOGYO) and a nonionic reactive emulsifier (RN-10; DAI-ICH KOGYO) in weight ratios illustrated in Table 2 below, 60 g of a black pigment and 400 g of glass beads having a diameter of 0.8 to 1 mm were added to a milling bath, and the mixture was milled at room temperature to prepare a dispersion using a ultrasonic homogenizer.

Agglomeration and Preparation of Toner 500 g deionized water, 150 g of the first latex for a core and 35 g of the pigment dispersion were added to a 1 L reactor. A mixture of 15 g of PSI-(025) sold by SOODO Mechanical Co. and 15 g nitric acid (0.3 mol) was added to the reactor and the mixture was agitated at 11,000 rpm for 6 minutes using a homogenizer to obtain agglomerate having a diameter of 1.5 to 2.5 μm. The resultant was added to a 1 L double jacketed reactor, and heated from room temperature to 50° C. (Tg of the latex-5° C.) at a rate of 0.02° C. per minute. When particles having a diameter of about 5.5 μm or less, 3 μm or less are 2% by volume or less, 50 g of a second latex prepared by polymerizing polystyrene-based polymerizable monomers was added thereto. When a volume average diameter (D50) of the particles reached 5.8 μm, NaOH (1 mol) was added thereto to adjust the pH to 7. When the D50 of the particles was constantly maintained for 10 minutes, the temperature was increased to 96° C. at a rate of 0.5° C./min. When the temperature reached 96° C., nitric acid (0.3 mol) was added thereto to adjust the pH to 6.6. Then, the resultant was agglomerated for 3-5 hours to obtain a second agglomerated toner having a diameter of 5-6 μm in a potato-shape. Then, the second agglomerated toner was cooled to a temperature lower than Tg, filtered to be separated, and dried.

Figure 3:
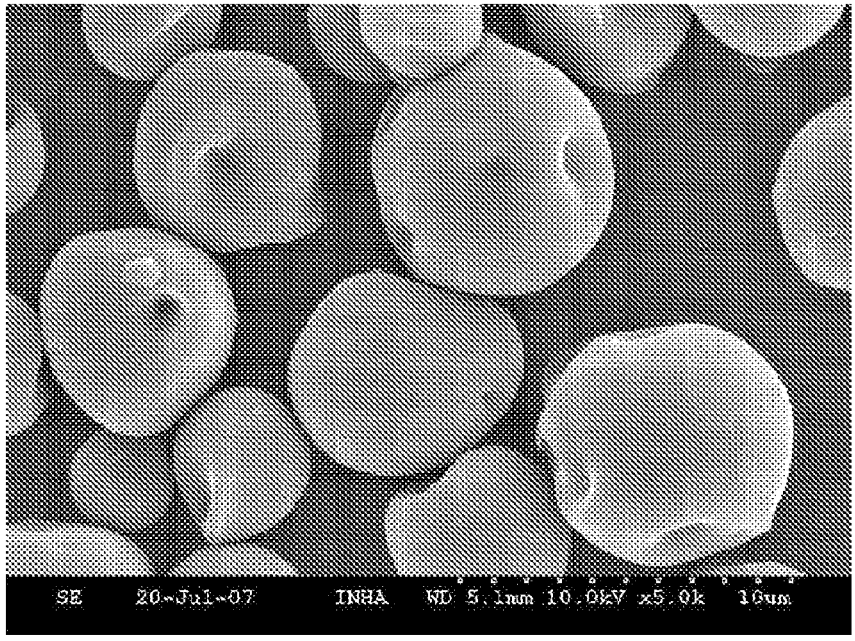
FIG. 3 is a SEM image of agglomerated toner prepared according to Example 1.

The dried toner particles were subjected to a surface treatment by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and agitating the mixture in a mixer (Piccolo, Kawata) at 3,000 rpm for 5 minutes. Toner having D50 of 5.8 was obtained. FIG. 3 is a SEM image of the agglomerated toner prepared according to Example 1.

GSDp and GSDv of the toner were respectively 1.23 and 1.22.

EXAMPLE 2

Figure 4:
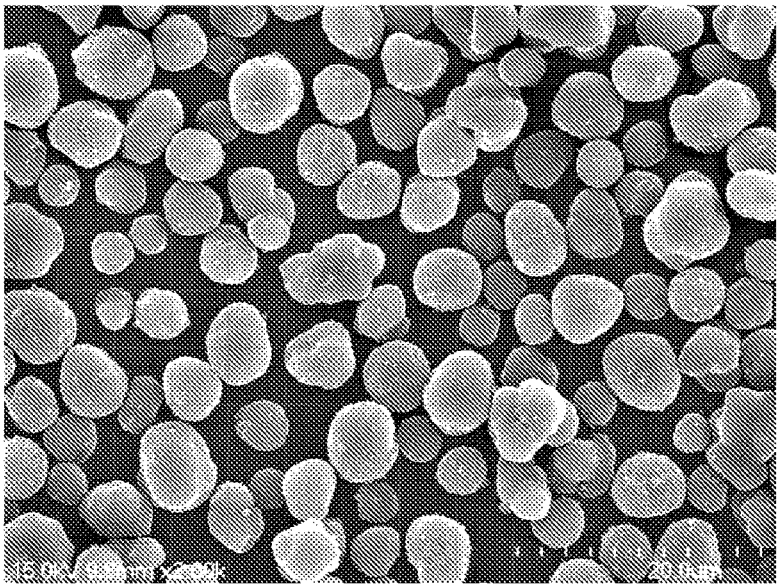
FIG. 4 is a SEM image of agglomerated toner prepared according to Example 2.

Toner was prepared in a same manner as in Example 1, except that PSI-100 was used instead of PSI-025. FIG. 4 is a SEM image of the agglomerated toner prepared according to Example 2.

GSDp and GSDv of the toner were respectively 1.23 and 1.22.

EXAMPLE 3

Figure 5:
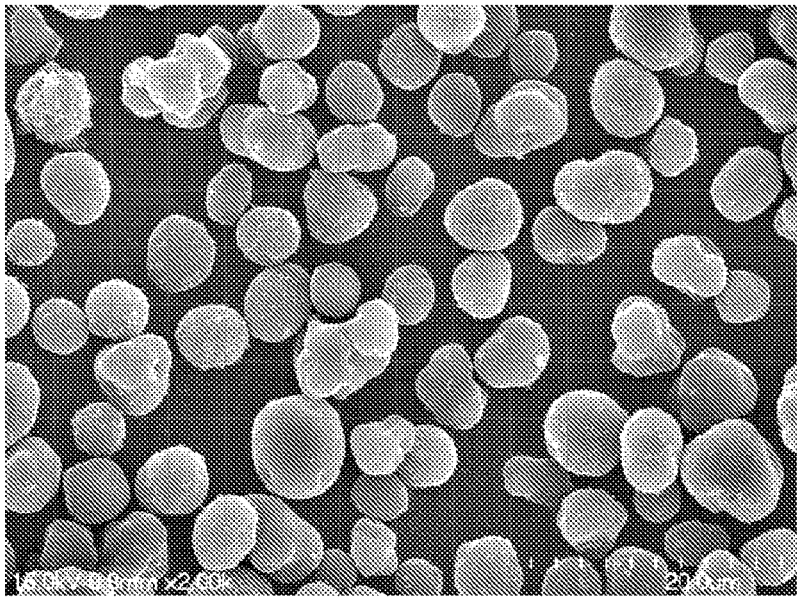
FIG. 5 is a SEM image of agglomerated toner prepared according to Example 3.

Toner was prepared in the same manner as in Example 1, except that PSI-300 was used instead of PSI-025. FIG. 5 is a SEM image of the agglomerated toner prepared according to Example 3.

GSDp and GSDv of the toner were respectively 1.23 and 1.21.

EXAMPLE 4

Figure 6:
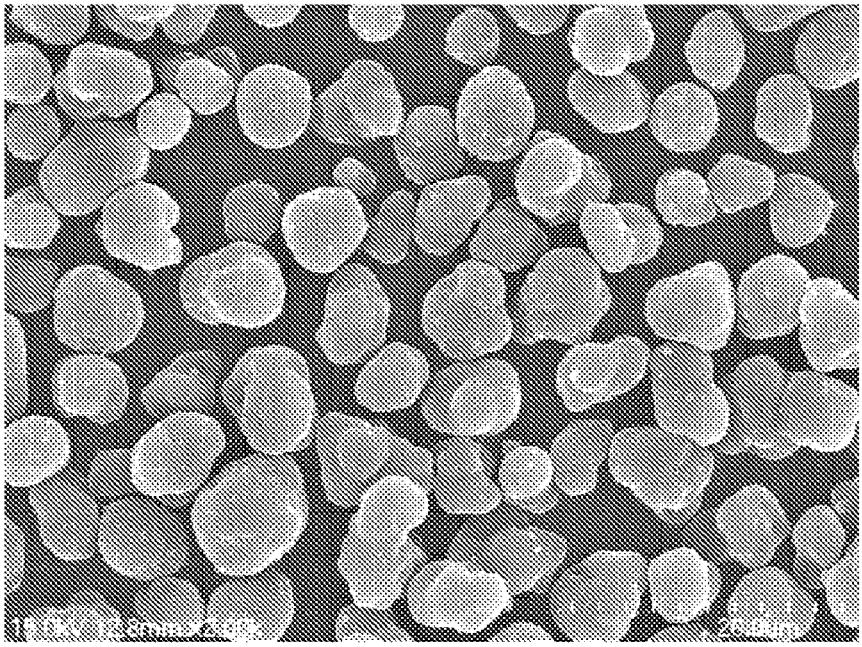
FIG. 6 is a SEM image of agglomerated toner prepared according to Example 4.

Toner was prepared in the same manner as in Example 1, except that a cyan pigment illustrated in Table 2 below was used instead of the black pigment. FIG. 6 is a SEM image of the agglomerated toner prepared according to Example 4.

GSDp and GSDv of the toner were respectively 1.24 and 1.21.

EXAMPLE 5

Figure 7:
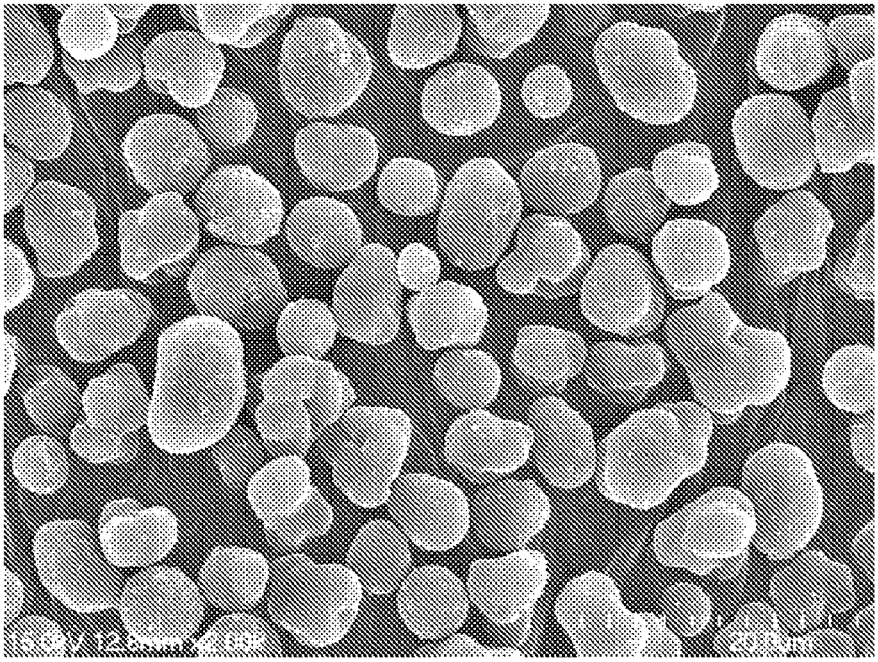
FIG. 7 is a SEM image of agglomerated toner prepared according to Example 5.

Toner was prepared in the same manner as in Example 1, except that a magenta pigment (a rhodamine) illustrated in Table 2 below was used instead of the black pigment. FIG. 7 is a SEM image of the agglomerated toner prepared according to Example 5.

GSDp and GSDv of the toner were respectively 1.24 and 1.21.

EXAMPLE 6

Figure 8:
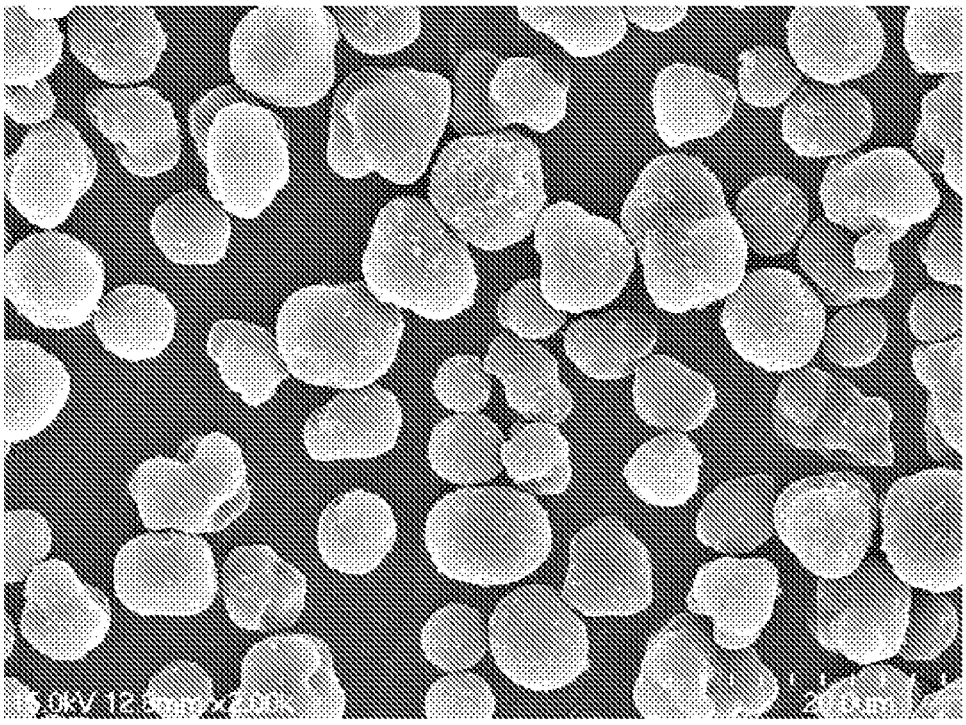
FIG. 8 is a SEM image of agglomerated toner prepared according to Example 6.

Toner was prepared in the same manner as in Example 1, except that a yellow pigment illustrated in Table 2 below was used instead of the black pigment. FIG. 8 is a SEM image of the agglomerated toner prepared according to Example 6.

GSDp and GSDv of the toner were respectively 1.23 and 1.20.

TABLE 2

| Color | Pigment | HS-10:RN-10 (weight ratio) |
|---|---|---|
| Black | Mogul-L | 100:0 |
| | | 80:20 |
| | | 0:100 |
| Yellow | PY-74 | 100:0 |
| | | 50:50 |
| | | 0:100 |
| Magenta | PR-122 | 100:0 |
| | | 50:50 |
| | | 0:100 |
| Cyan | PB 15:4 | 100:0 |
| | | 80:20 |
| | | 70:30 |

COMPARATIVE EXAMPLE 1

Toner was prepared in the same manner as in Example 1, except that 30 g of $MgCl_2$ was used as an agglomerating agent instead of PSI-025 which is polysilica iron, the reaction was performed at 95° C. for 4 hours, and a latex for a shell was added after adding NaCl and the resultant was agglomerated for 8 hours.

COMPARATIVE EXAMPLE 2

Toner was prepared in the same manner as in Example 1, except that 1 g of PAC was used as an agglomerating agent instead of PSI-025 which is polysilica iron.

The agglomerating agent used in the present general inventive concept can be efficiently applied to various methods of forming images and image forming apparatuses since toner can be prepared with only a small amount of the agglomerating agent, toner can be agglomerated at a low temperature, coloring pigment, particularly a rhodamine-based pigment, can be efficiently agglomerated, durability of toner can be improved by forming a shell layer, toner can be fixed at a low temperature, and fine-particle toner can be prepared by using the agglomerating agent.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An electrophotographic toner, comprising:

a latex;

a coloring agent;

a wax; and metal salt having Si and Fe, wherein the toner includes 3 to 1,000 pm of each of Si and Fe, and a mole ratio of Si to Fe is from 0.1 to 5.

2. The electrophotographic toner of claim 1, wherein an average particle size of the toner is in a range of 3 to 8 μm.

3. The electrophotographic toner of claim 1, wherein an average sphericity of the toner is in a range of 0.940 to 0.970.

4. The electrophotographic toner of claim 1, wherein the average sphericity difference between toner having an average particle size of 2 μm and 5 μm is less than 0.02.

5. The electrophotographic toner of claim 1, wherein GSDv and GSDp values of the toner are respectively less than 1.25.

6. A method of preparing an electrophotographic toner, the method comprising:

preparing a first agglomerated toner by mixing first latex particles including a wax with a pigment dispersion, and adding a metal salt including Si and Fe to the mixture; and preparing a second agglomerated toner by coating a second latex obtained by polymerizing one or more polymerizable monomers on the first agglomerated toner, wherein the electrophotographic toner includes 3 to 1,000 ppm of each of Si and Fe, and a mole ratio of Si to Fe is from 0.1 to 5.

7. The method of claim 6, wherein the first latex particles comprise:

polyester, a polymer obtained by polymerizing one or more polymerizable monomers, or a mixture of the polyester and the polymer.

8. The method of claim 6, further comprising:

coating a third latex prepared by polymerizing one or more polymerizable monomers on the second agglomerated toner.

9. The method of claim 6, wherein the metal salt comprising:

Si and Fe is polysilica iron.

10. The method of claim 6, wherein the one or more polymerizable monomers comprise one or more monomers selected from the group consisting of styrene-based monomers such as styrene, vinyl toluene and α-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and metacryl amide; ethylenically unsaturated monoolefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

11. A method of forming images, the method comprising:

attaching toner to a surface of a photoreceptor on which an electrostatic latent image is formed to form a visualized image and transferring the visualized image to a transfer medium, wherein the toner is an electrophotographic toner prepared by preparing a first agglomerated toner by mixing first latex particles including a wax with a pigment dispersion, and adding a metal salt including Si and Fe to the mixture, and preparing a second agglomerated toner by coating a second latex obtained by polymerizing one or more polymerizable monomers on the first agglomerated toner, wherein the electrophotographic toner includes 3 to 1,000 ppm of each of Si and Fe, and a mole ratio of Si to Fe is from 0.1 to 5.

12. An image forming apparatus, comprising:

an organic photoreceptor;

an image forming unit to form an electrostatic latent image on a surface of the organic photoreceptor;

a unit to receive toner;

a toner supplying unit to supply the toner onto the surface of the organic photoreceptor in order to form a toner image by developing the electrostatic latent image to form the toner image; and a toner transferring unit to transfer the toner image to a transfer medium from the surface of the organic photoreceptor, wherein the toner is an electrophotographic toner including a latex, a coloring agent, a wax and metal salt having Si and Fe, and the toner includes 3 to 1,000 ppm of each of Si and Fe such that a mole ratio of Si to Fe is from 0.1 to 5.

13. A developing unit usable with an image forming apparatus, the developing unit comprising:

a storage portion to store an electrophotographic toner, wherein the electrophotographic toner includes a latex, a coloring agent, a wax and metal salt having Si and Fe, and the toner includes 3 to 1,000 ppm of each of Si and Fe such that a mole ratio of Si to Fe is from 0.1 to 5.

14. The electrophotographic toner of claim 1, wherein the metal salt includes polysilica iron.

15. The electrophotographic toner of claim 1, wherein metal salt has a viscosity of greater than or equal to 2.0 mPa·S.

16. The electrophotographic toner of claim 1, wherein the metal salt has a mean molecular weight of 500,000 Dalton.

17. The electrophotographic toner of claim 1, wherein the latex includes latex particles coated with a latex shell layer.

18. The electrophotographic toner of claim 1, further comprising a charge control agent to support toner on a developing roller by electrostatic force.

19. The electrophotographic toner of claim 18, wherein the charge control agent is a negative charge type including at least one of:

an organic metal complex, a chelate compound, a salicylic acid compound containing metal, and an organic metal complex of an aromatic hydroxycarboxylic acid and an aromatic dicarboxylic acid.

20. The electrophotographic toner of claim 18, wherein the charge control agent is a positive charge type including at least one of:

a nigrosine and a fatty acid metal salt thereof, and an onium salt including a quaternary ammonium salt.

* * * * *